US007694662B2

(12) United States Patent
Onuma et al.

(10) Patent No.: US 7,694,662 B2
(45) Date of Patent: Apr. 13, 2010

(54) BYPASS-INTAKE-FLOW CONTROL APPARATUS

(75) Inventors: Michio Onuma, Kakuda (JP); Masaaki Mitobe, Kakuda (JP); Rumi Nobe, Kakuda (JP); Minoru Suzuki, Kakuda (JP); Yuki Fujino, Kakuda (JP); Masako Hagiya, Kakuda (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 12/254,335

(22) Filed: Oct. 20, 2008

(65) Prior Publication Data

US 2009/0114186 A1 May 7, 2009

(30) Foreign Application Priority Data

Nov. 7, 2007 (JP) ..... 2007-289978

(51) Int. Cl.
*F02M 3/00* (2006.01)
*F02D 41/06* (2006.01)

(52) U.S. Cl. ..... 123/339.1; 123/339.13; 123/339.14; 123/179.16; 123/179.18

(58) Field of Classification Search ..... 123/179.16, 123/179.18, 339.1, 339.13, 339.14, 339.25
See application file for complete search history.

(56) References Cited

U.S. PATENT DOCUMENTS 4,823,750 A * 4/1989 Niida et al. ..... 123/339.28
5,042,448 A * 8/1991 Cook et al. ..... 123/339.28
7,156,073 B2 * 1/2007 Kure ..... 123/337

FOREIGN PATENT DOCUMENTS

JP 3784679 B2 3/2006

* cited by examiner

*Primary Examiner*—Stephen K Cronin
*Assistant Examiner*—J. Page Hufty
(74) *Attorney, Agent, or Firm*—Arent Fox LLP

(57) ABSTRACT

The invention aims to prevent the dust passing through a gap provided for sliding movement of bypass valve from being attached to a screw mechanism, and thus to guarantee smooth motion of the screw mechanism. Provided is a bypass-intake-flow control apparatus including a throttle body in which a bypass and a valve hole that is open into the course of the bypass are formed. A bypass valve to open and close the bypass is slidably but not rotatably fitted into the valve hole. An actuator is attached to the throttle body with an output shaft arranged coaxially with the bypass valve. The screw mechanism links the output shaft and the bypass valve. A bottomed hollow portion is formed in the bypass valve with an opening facing the actuator. A dust cover that surrounds the screw mechanism in the hollow portion is attached to the throttle body.

5 Claims, 5 Drawing Sheets

BYPASS-INTAKE-FLOW CONTROL APPARATUS

BACKGROUND OF THE INVENTION

1. Field of the Invention

The present invention relates to an improvement of a bypass-intake-flow control apparatus in which a throttle body having an intake passage that is opened and closed by a throttle valve is provided with: a bypass connected to the intake passage while bypassing the throttle valve; and a valve hole open into the bypass, a bypass valve that opens and closes the bypass by moving in an axial direction is slidably but not rotatably fitted into the valve hole, an output shaft of an actuator that is attached to the throttle body is arranged substantially-coaxially with the bypass valve, the output shaft and the bypass valve are linked by a screw mechanism, so that the bypass valve is driven in an axial direction by rotation of the output shaft so as to be opened and closed.

2. Description of the Related Art

Such bypass-intake-flow control apparatus has already been known as disclosed in Japanese Patent No. 3784679.

SUMMARY OF THE INVENTION

In the conventional bypass-intake-flow control apparatus, a gap for allowing the bypass valve to slide is left between the valve hole and the bypass valve. When the bypass valve is open, the dust that is inevitably included in the air passing through the bypass may possibly pass through the gap for sliding. While the dust is passing through the gap, the dust may be attached to the screw mechanism to hinder the smooth motion of the screw mechanism, and may possibly change the bypass-intake-flow control characteristics.

The present invention is made in view of the above-described circumstances. An object of the present invention is to provide a bypass-intake-flow control apparatus with the following characteristic features. Even when the dust passes through the gap provided for the sliding movement of the bypass valve, the bypass-intake-flow control apparatus prevents the dust from being attached to the screw mechanism, so that the smooth motion of the screw mechanism is guaranteed. Thus, smooth motion of the screw mechanism can contribute to an improvement in the stability of the bypass-intake-flow control characteristics.

In order to achieve the object, according to a first feature of the present invention, there is provided a bypass-intake-flow control apparatus in which a throttle body having an intake passage that is opened and closed by a throttle valve is provided with: a bypass connected to the intake passage while bypassing the throttle valve; and a valve hole open into the bypass, a bypass valve that opens and closes the bypass by moving in an axial direction is slidably but not rotatably fitted into the valve hole, an output shaft of an actuator that is attached to the throttle body is arranged substantially-coaxially with the bypass valve, the output shaft and the bypass valve are linked by a screw mechanism, so that the bypass valve is driven in an axial direction by rotation of the output shaft so as to be opened and closed, wherein the bypass-intake-flow control apparatus comprises: a bottomed hollow portion formed in the bypass valve with an opening facing the actuator; and a dust cover that surrounds the screw mechanism by the hollow portion and that is attached to the throttle body.

With the first feature of the present invention, the bottomed hollow portion is formed in the bypass valve with an opening facing the actuator, and the dust cover that surrounds the screw mechanism in the hollow portion is attached to the throttle body. For this reason, even when the dust included in the air passing through the bypass passes through the gap for the sliding movement of the bypass valve, the dust cover prevents the dust from being attached to the screw mechanism. Accordingly, the smooth operation of the screw mechanism is guaranteed while an improvement in the stability of bypass-intake-flow control characteristics can be accomplished. In addition, the dust cover can be installed in the bypass valve, so that the bypass-intake-flow control apparatus can be prevented from being larger in size.

According to a second feature of the present invention, in addition to the first feature, the screw mechanism includes: a threaded shaft provided contiguously from the output shaft; and a driving member including a threaded hole that is screwed with the threaded shaft, and an Oldham's coupling that links the driving member and the bypass valve is provided on a bottom wall of the bottomed hollow portion of the bypass valve.

With the second feature of the present invention, the Oldham's coupling absorbs the deviation in the radial direction between the output shaft of the actuator and the bypass valve. Such absorption guarantees smooth sliding movement of the bypass valve. In addition, the Oldham's coupling is installed compactly in the bypass valve while preventing the interference between the Oldham's coupling and the dust cover. As a consequence, the bypass-intake-flow control apparatus can be made compact in size.

According to a third feature of the present invention, in addition to the first feature, a flange portion is formed in the dust cover, and is clamped and fixed between the throttle body and the actuator attached thereto.

With the third feature of the present invention, the dust cover is attached by holding the flange portion of the dust cover by and between the throttle body and the actuator that is attached to the throttle body. The dust cover thus held is then fixed. No special fixing means for attaching the dust cover is necessary. Accordingly, the attachment structure of the dust cover can be simplified.

According to a fourth feature of the present invention, in addition to the second feature, there is provided the bypass-intake-flow control apparatus further comprising: a stopper pin that abuts on the tip end of the output shaft so as to set a fully-open side movement limit of the bypass valve; and a set pin that is positioned outwardly of the stopper pin in the axial direction of the driving member and that supports a set spring of the bypass valve, wherein the threaded hole penetrates the driving member in the axial direction, the stopper pin and the set pin are attached in an outer-end portion of the driving member, that outer-end portion penetrates the bottom wall of the bypass valve, the stopper pin and the set pin being attached so as to penetrate the driving member laterally, and grease is filled in a portion of the threaded hole that is located between the stopper pin and the set pin.

With the fourth feature of the present invention, the grease that is held between the set pin and the stopper pin fills the threaded hole. For this reason, no special closure member is fitted into the threaded hole to close the threaded hole. The intrusion of the dust through the threaded hole into the screw mechanism can be prevented.

According to a fifth feature of the present invention, in addition to the first feature, there is provided the bypass-intake-flow control apparatus further comprising: rotation preventing means that prevents the bypass valve from rotating and that allows the bypass valve to slide in the axial direction; and a partition wall that is contiguous from the outer circumferential surface of the bypass valve, wherein the rotation preventing means includes: a key groove that is formed in a side surface of the bypass valve and that extends in the axial direction; and a key that is provided in a protruding manner in the inner surface of the valve hole, and that slidably engages with the key groove, and at least an end of the key groove is closed by the partition wall.

With the fifth feature of the present invention, the partition wall can effectively prevent the dust from intruding into the hollow portion of the bypass valve through the key groove of the rotation preventing means.

Note that the above-mentioned actuator corresponds to an electric motor in the embodiments of the present invention, which will be described below.

Modes of carrying out the present invention will be described below on the basis of a preferred embodiment of the present invention with reference to the accompanying drawings.

DESCRIPTION OF THE PREFERRED EMBODIMENTS

To begin with, a first embodiment of the present invention will be described with reference to FIGS. 1 to 4.

Figure 1:
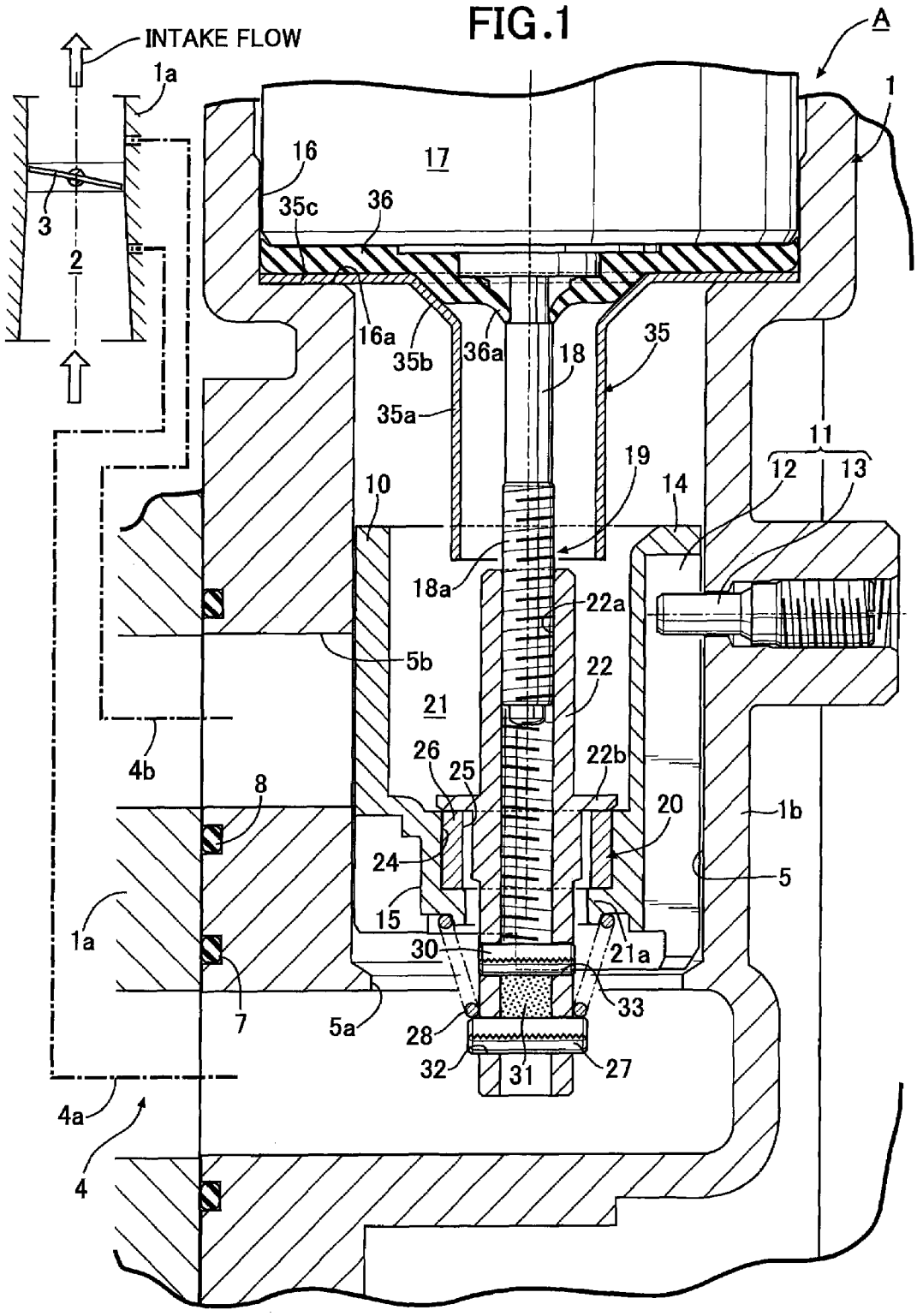
FIG. 1 is a vertical sectional view of a bypass-intake-flow control apparatus according to a first embodiment of the present invention with a bypass valve being fully closed.
Figure 2:
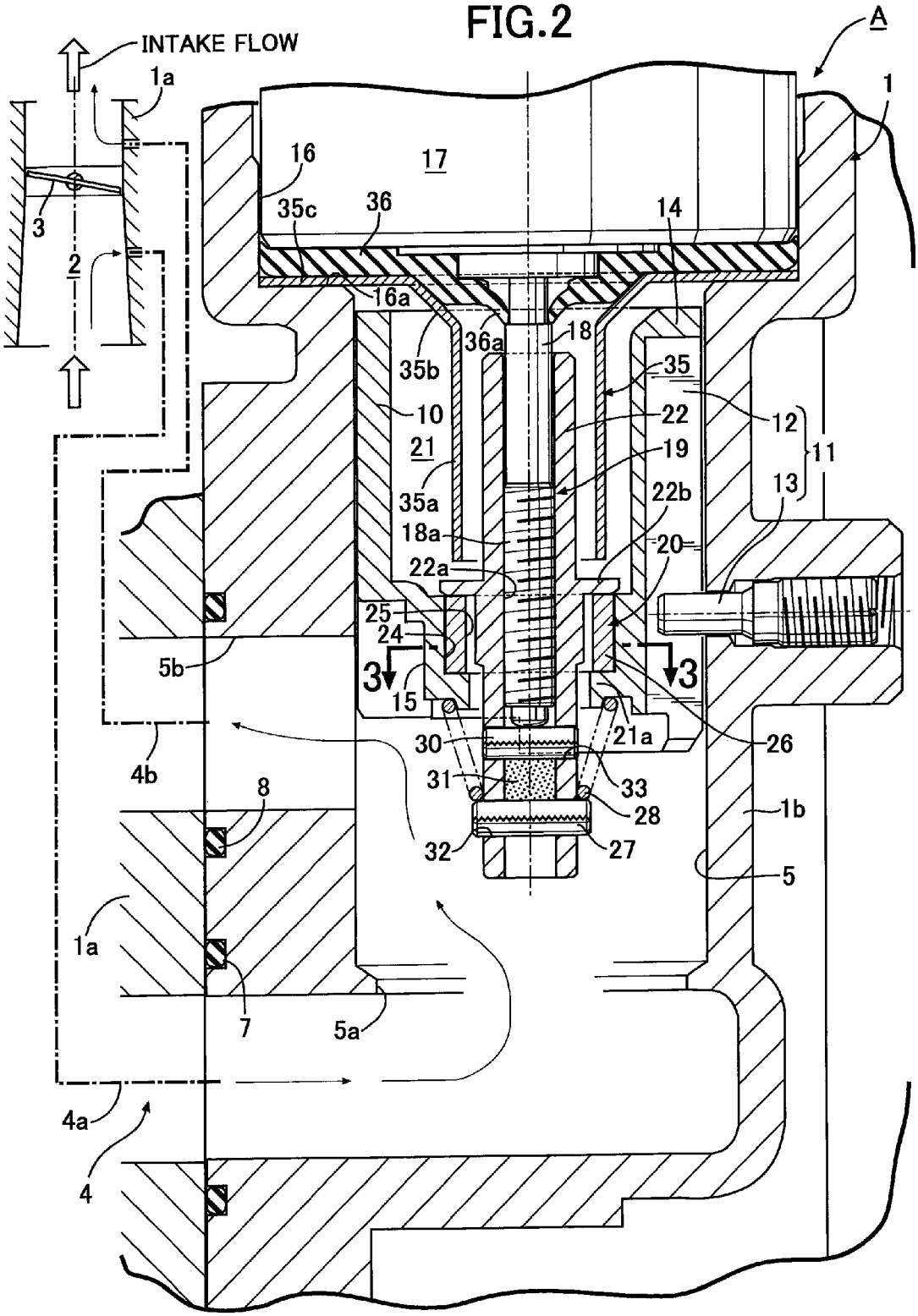
FIG. 2 is a vertical sectional view of the same apparatus with the bypass valve being fully opened.

FIGS. 1 and 2 show a bypass-intake-flow control apparatus A of the present invention. The bypass-intake-flow control apparatus A includes a throttle body 1, which is attached to an unillustrated cylinder head of the engine. The throttle body 1 includes a main body 1*a* and a sub body 1*b*. The main body 1*a* includes an intake passage 2, which is communicatively connected to the intake port of the engine. The sub body 1*b* is bolted to a side of the main body 1*a*. A butterfly-type throttle valve 3 is pivotally supported by the main body 1*a* so as to open and close the intake passage 2. A bypass 4 is formed across the main body 1*a* and the sub body 1*b*. The bypass 4 is connected to the intake passage 2 while bypassing the throttle valve 3.

A valve hole 5 that has a shape of a bottomed cylinder is formed in the sub body 1*b* so as to be open into the course of the bypass 4. A downstream end of an upstream-side passage 4*a* of the bypass 4 forms an opening in the bottom face of the valve hole 5. The opening thus formed is a valve-hole inlet 5*a*. In addition, an upstream end of a downstream-side passage 4*b* of the bypass 4 forms an opening in a side surface of the valve hole 5. The opening thus formed is a valve-hole exit 5*b*. While the upstream-side passage 4*a* and the downstream-side passage 4*b* penetrate the joint face of the main body 1*a* and the joint face of the sub body 1*b*, O-rings 7 and 8 are set between these joint face of the main body 1*a* and the joint face of the sub body 1*b* so as to surround, respectively, the upstream-side passage 4*a* and the downstream-side passage 4*b*.

A bypass valve 10 that has a shape of a piston is fitted into the valve hole 5. The bypass valve 10 is slidable so as to open and close the valve-hole inlet 5*a* and the valve-hole exit 5*b*. A rotation preventing means 11 is provided between the bypass valve 10 and the sub body 1*b* so as to prevent the bypass valve 10 from rotating. The rotation preventing means 11 includes a key groove 12 and a key 13. The key groove 12 formed in a first side surface of the bypass valve 10 so as to extend in the axial direction of the bypass valve 10. The key 13 is screwed into the sub body 1*b* so as to slidably engage with the key groove 12. An end portion of the key groove 12 located on the electric motor 17 side is closed by a partition wall 14 that is formed integrally with and contiguously from the outer circumferential surface of the bypass valve 10.

A cutaway 15 is formed in a second side surface of the bypass valve 10. The cutaway 15 has an opening facing the valve-hole inlet 5*a*, and is formed for the measurement purpose. The bypass valve 10 is movable in the axial direction from the position shown in FIG. 1, where the bypass valve 10 is to be fully closed, and to the position shown in FIG. 2, where the bypass valve 10 is fully opened. With the movement of the bypass valve 10, the degree of communication between the cutaway 15 and the valve-hole exit 5*b* can be adjusted from zero to the maximum.

An attachment hole 16 is formed in the sub body 1*b* at an end portion located on the side opposite to the valve-hole inlet 5*a* of the valve hole 5. The attachment hole 16 is formed concentrically with and contiguously from the valve hole 5 with a ring-shaped shoulder 16*a* formed in between. The electric motor 17 is attached to the attachment hole 16. The electric motor 17 has an output shaft 18 that is linked to the bypass valve 10 via, sequentially, a screw mechanism 19 and an Oldham's coupling 20. A bottomed hollow portion 21 is formed in the bypass valve 10. The hollow portion 21 has an opening on the electric motor 17 side. The screw mechanism 19 is installed in the hollow portion 21 while the Oldham's coupling 20 is set on a bottom wall 21*a* of the hollow portion 21.

The screw mechanism 19 includes a threaded shaft 18*a* and a driving member 22. The threaded shaft 18*a* is formed integrally with and contiguously from the output shaft 18 of the electric motor 17. A threaded hole 22*a* into which the threaded shaft 18*a* is screwed is formed in the driving member 22.

Figure 3:
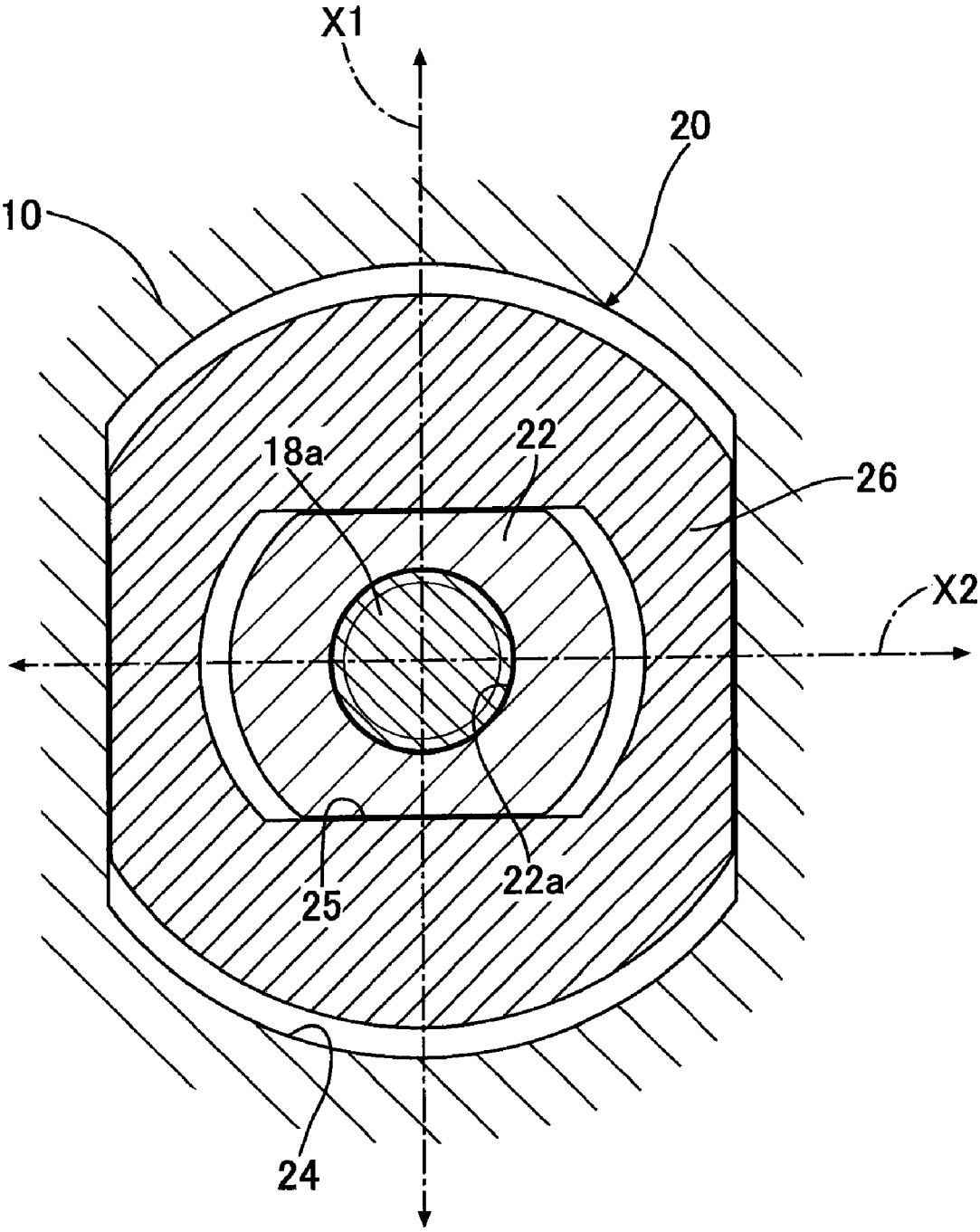
FIG. 3 is a sectional view taken along a line 3-3 of FIG. 2.

As FIGS. 2 and 3 show, the Oldham's coupling 20 includes a first rectangular hole 24, a joint member 26, and a second rectangular hole 25. The first rectangular hole 24 is formed in the bottom wall 21*a* of the bottomed hollow portion 21 of the bypass valve 10. The joint member 26 is fitted into the first rectangular hole 24 so as to be slidable in a first lateral direction X1. The second rectangular hole 25 is formed in the joint member 26. The driving member 22 is fitted into the second rectangular hole 25 so as to be slidable in a second lateral direction X2 that is perpendicular to the first lateral direction X1. The driving member 22 is formed to be relatively long so as to penetrate the joint member 26 and the bottom wall 21*a*. The threaded hole 22*a* penetrates the driving member 22 in the axial direction. A flange 22*b* is formed in the middle portion of the driving member 22, and abuts on the outer-end face of the joint member 26.

An outer-end portion of the driving member 22 sticks out of the bottom wall 21*a*. A set pin 27 is fitted into the outer end portion so as to get across the outer-end portion. A set spring 28 with a shape of a conical coil is compressed and set between the set pin 27 and the bypass valve 10. The compressive repulsive force of the set spring 28 pushes the flange 22*b* of the driving member 22 onto the outer-end face of the joint member 26. The joint member 26 thus pushed is kept abutting on the bottom wall 21*a*.

A stopper pin 30 is fitted into the driving member 22 so as to get across the driving member 22. The stopper pin 30 is provided at a position located at the inner side, in the axial direction, of the set pin 27. The stopper pin 30 receives the tip end of the threaded shaft 18*a*, and thus sets the fully-open side movement limit of the bypass valve 10.

Grease 31 is filled in the threaded hole 22*a* so as to leave no space in the threaded hole 22*a*, specifically, the grease 31 is filled in the portion between the set pin 27 and the stopper pin 30.

Spring pins are used for the two pins 27 and 30. The pins 27 and 30 are held respectively in attachment holes 32 and 33 that are formed in the driving member 22. Each of the pins 27 and 30 is tightly attached, by the spring force thereof, to the inner circumferential surface of the corresponding one of the attachment holes 32 and 33.

Figure 4:
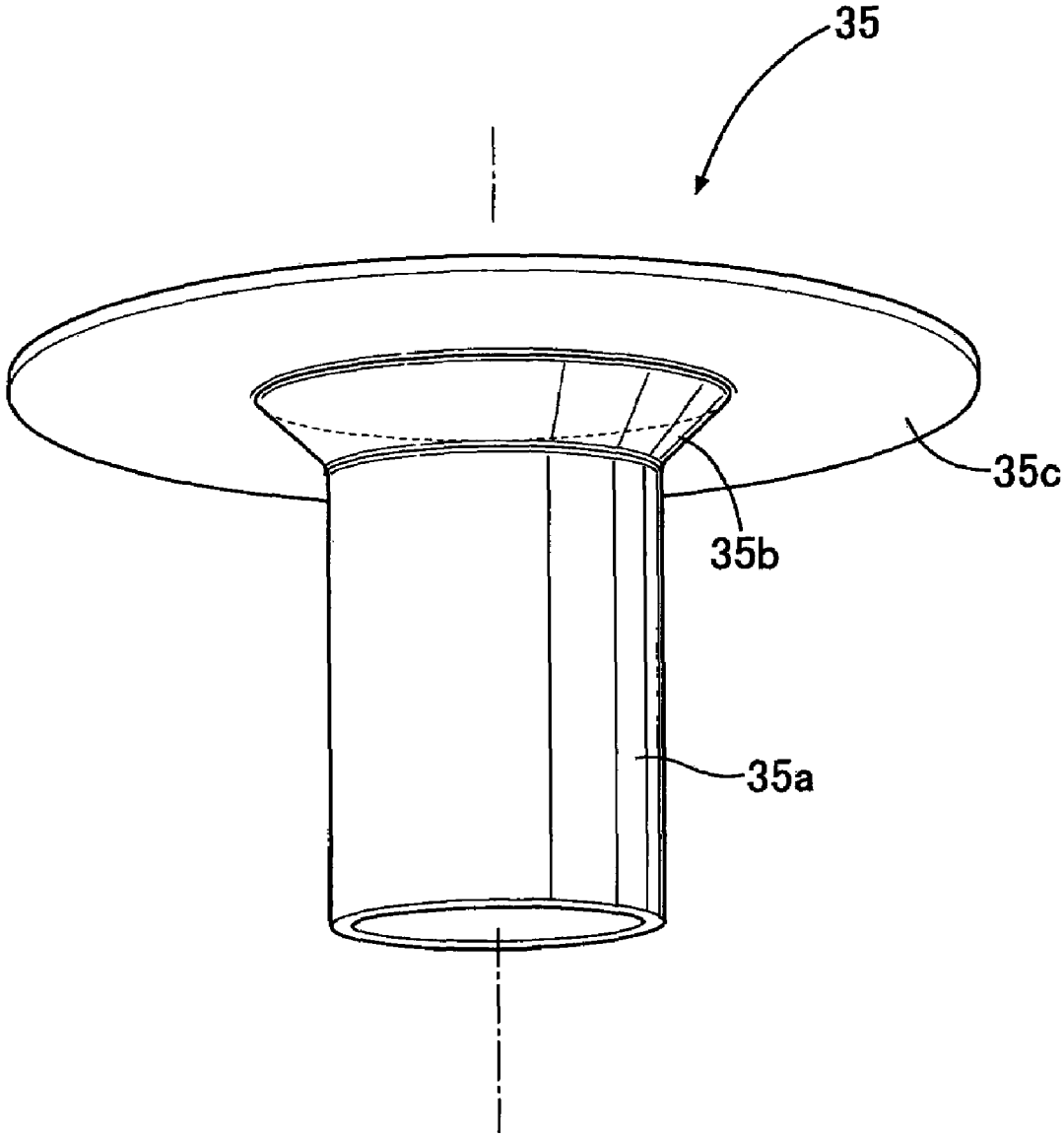
FIG. 4 is a perspective view of a dust cover provided in the same apparatus.

As FIGS. 2 and 4 show, a dust cover 35 is attached to the sub body 1*b*. The dust cover 35 surrounds the screw mechanism 19 in the bottomed hollow portion 21 of the bypass valve 10 when the bypass valve 10 is at the fully-open position or at a position near the fully-open position. The dust cover 35 includes a cylindrical portion 35*a* and a flange portion 35*c*. The cylindrical portion 35*a* surrounds coaxially the screw mechanism 19. A conical portion 35*b* is formed at an end portion, located on the electric motor 17 side, of the cylindrical portion 35*a*. The flange portion 35*c* is formed integrally with and contiguously from the above-mentioned end portion of the cylindrical portion 35*a* with the conical portion provided in between. The flange portion 35*c*, together with a seal member 36, is held between the ring-shaped shoulder portion 16*a* of the sub body 1*b* and the end face of the electric motor 17 that is held by being pressed onto the ring-shaped shoulder portion 16*a*. The seal member 36 includes a seal lip 36*a* that is tightly in contact with the outer circumferential surface of the base portion of the output shaft 18. The conical portion 35*b* of the dust cover 35 holds the seal lip 36*a* by pressing the seal lip 36*a* inwards in the radial direction.

The cylindrical portion 35*a* of the dust cover 35 has a length described as follows. When the bypass valve 10 is moved to the fully-open side by the maximum distance, the tip end of the cylindrical portion 35*a* does not touch the flange 22*b* of the driving member 22, the flange 22*b* pressing the joint member 26.

An unillustrated electronic control unit is provided in the sub body 1*b*. The electronic control unit judges which of the operating states the engine is in, for example, the engine is in: a state of being started; a state of fast idling; a state of normal idling; and a state of engine braking. The judgment is based on the output signals of various sensors, such as a throttle sensor, an intake-air temperature sensor, and a boost negative-pressure sensor. On the basis of the judgment, the electronic control unit activates the electric motor 17 so as to make the electric motor 17 rotate either in the normal direction or in the inverse direction.

Subsequently, advantageous operations of this embodiment will be described.

When the output shaft 18 of the electric motor 17 rotates either in the normal direction or in the inverse direction, the driving member 22, fed by the axial feeding operation of the screw mechanism 19, either moves forwards or backwards in the axial direction. The driving member 22 makes the joint member 26 cause the bypass valve 10 to slide in the axial direction along the valve hole 5. Accordingly, the degree of communication between the cutaway 15 and the valve-hole exit 5*b*, that is, the opening degree of the bypass 4, is either increased or decreased. What is made possible in this way is the control of the bypass intake flow of the engine, which intake flow passes, sequentially, through the upstream-side passage 4*a*, the valve-hole inlet 5*a*, the valve hole 5, the cutaway 15, the valve-hole exit 5*b*, and the downstream-side passage 4*b* of the bypass 4.

Incidentally, when the bypass valve 10 is located at the fully-open position or at a position near the fully-open position, the intake flow of the bypass 4 is especially large. The dust inevitably included in the air passing through the bypass 4 may pass, together with the air, through the gap that allows the bypass valve 10 to slide in the valve hole 5. However, the dust cover 35 attached to the sub body 1*b* surrounds the screw mechanism 19 connecting the output shaft 18 of the electric motor 17 and the driving member 22. As a result, the dust cover 35 can prevent the dust from being attached to and deposited on the screw mechanism 19, that is, the threaded shaft 18*a* and the threaded hole 22*a* even in this case. Accordingly, the smooth motion of the screw mechanism 19 can be guaranteed while an improvement in the stability of the bypass-intake-flow control characteristics can be obtained.

In addition, the dust cover 35 is attached by holding the flange portion 35*c* of the dust cover 35 by and between the ring-shaped shoulder portion 16*a* of the attachment hole 16 of the sub body 1*b* and the end face of the electric motor 17 that is attached to the attachment hole 16. Therefore, no special fixing means for attaching the dust cover 35 is necessary. Accordingly, the attachment structure for the dust cover 35 can be simplified.

In addition, the air that flows through the bypass 4 sometimes flows into the key groove 12 of the rotation preventing means 11 of the bypass valve 10. The end portion of the key groove 12 located on the electric motor 17 side, however, is closed by the partition wall 14 that is contiguous from the outer circumferential surface of the bypass valve 10. Accordingly, the partition wall 14 effectively prevents the air that has been flown in the key groove 12 from moving into the hollow portion 21 of the bypass 4. As a consequence, the intrusion of the dust through the key groove 12 into the hollow portion 21 of the bypass valve 10 can effectively be prevented.

In addition, the dust cover 35 is disposed in the hollow portion 21 of the bypass valve 10. Accordingly, the dust cover 35 is installed inside the bypass valve 10, so that the bypass-intake-flow control apparatus A can be prevented from being larger in size.

Now, suppose a case where there is a deviation, caused by a fabrication tolerance, between the axis of the bypass valve 10 and the axis of the output shaft 18 of the electric motor 17. The deviation is absorbed by the movement, in the first lateral direction X1, of the joint member 26 of the Oldham's coupling 20 and by the movement, in the second lateral direction X2, of the driving member 22. Accordingly, even with the above-mentioned deviation, a smooth sliding motion of the bypass valve 10 can be guaranteed. At the same time, the vibration of the bypass valve 10 can be suppressed by the set spring 28. In addition, the Oldham's coupling 20 is provided on the bottom wall 21*a* of the bottomed hollow portion 21 of the bypass valve 10. Accordingly, the interference between the Oldham's coupling 20 and the dust cover 35 provided in the hollow portion 21 can be avoided. Both the Oldham's coupling 20 and the dust cover 35 can be compactly installed in the bypass valve 10. As a consequence, the bypass-intake-flow control apparatus A can be made compact in size.

In addition, the grease 31 is filled in the portion of the threaded hole 22*a* between the set pin 27 and the stopper pin 30. The grease 31 is held between the set pin 27 and the stopper pin 30, and is thus used for filling the threaded hole

22*a*. Accordingly, the threaded hole 22*a* can be closed without fitting any special closure member into the threaded hole 22*a*. As a consequence, the intrusion of the dust from the threaded hole 22*a* to the screw mechanism 19 can be avoided.

Figure 5:
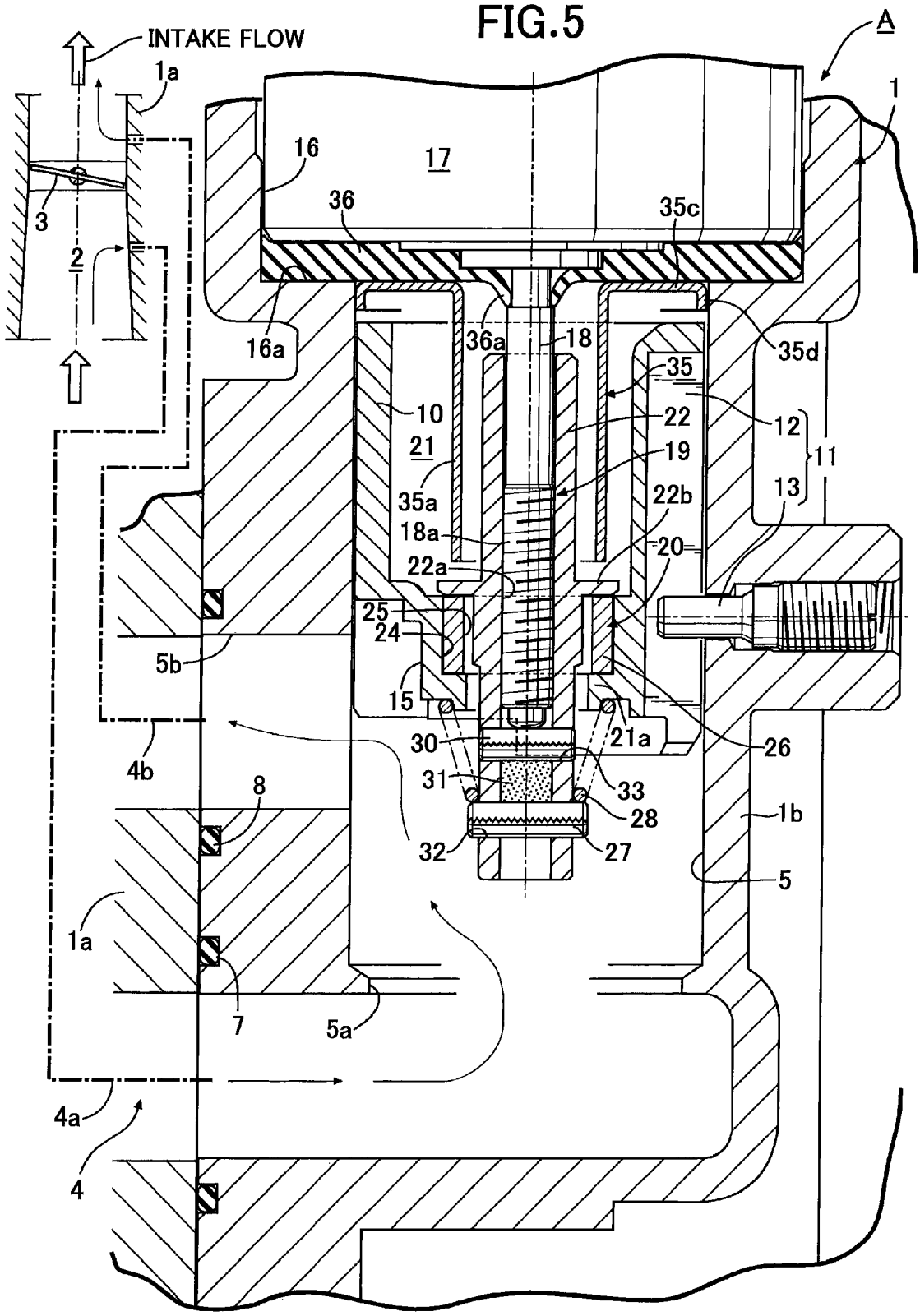
FIG. 5 shows a vertical section of a bypass-intake-flow control apparatus according to a second embodiment of the present invention and corresponding to FIG. 2.

Subsequently, a second embodiment of the present invention will be described with reference to FIG. 5. In the second embodiment, a fitting portion 35*d* with a shallow cylindrical shape is formed contiguously from the outer circumferential edge of the flange portion 35*c* that is formed so as to extend directly from an end of the cylindrical portion 35*a* of the dust cover 35. The fitting portion 35*d* is fixed to the inner circumferential surface of the valve hole 5 by means of press-fitting, welding, or bonding. The rest of the configuration is substantially the same as the configuration in the first embodiment, therefore, those parts shown in FIG. 5 will be given the same reference numbers as those given to their respective counterparts in the first embodiment. No description for those parts will be repeated.

The above-described embodiments are not the only modes of carrying out the present invention. Various changes in design are possible without departing from the scope of the present invention. For example, the throttle body 1 of the above-described embodiments is divided into the main body 1*a* and the sub body 1*b*, but the entire throttle body 1 may be formed in a single body.

What is claimed is:

1. A bypass-intake-flow control apparatus in which a throttle body having an intake passage that is opened and closed by a throttle valve is provided with: a bypass connected to the intake passage while bypassing the throttle valve; and a valve hole open into the bypass, a bypass valve that opens and closes the bypass by moving in an axial direction is slidably but not rotatably fitted into the valve hole, an output shaft of an actuator that is attached to the throttle body is arranged substantially-coaxially with the bypass valve, the output shaft and the bypass valve are linked by a screw mechanism, so that the bypass valve is driven in an axial direction by rotation of the output shaft so as to be opened and closed, wherein the bypass-intake-flow control apparatus comprises:

a bottomed hollow portion formed in the bypass valve with an opening facing the actuator; and a dust cover that surrounds the screw mechanism by the hollow portion and that is attached to the throttle body.

2. The bypass-intake-flow control apparatus according to claim 1, wherein the screw mechanism includes:

a threaded shaft provided contiguously from the output shaft; and a driving member including a threaded hole that is screwed with the threaded shaft, and an Oldham's coupling that links the driving member and the bypass valve is provided on a bottom wall of the bottomed hollow portion of the bypass valve.

3. The bypass-intake-flow control apparatus according to claim 1 wherein a flange portion is formed in the dust cover, and is clamped and fixed between the throttle body and the actuator attached thereto.

4. The bypass-intake-flow control apparatus according to claim 2 further comprising:

a stopper pin that abuts on the tip end of the output shaft so as to set a fully-open side movement limit of the bypass valve; and a set pin that is positioned outwardly of the stopper pin in the axial direction of the driving member and that supports a set spring of the bypass valve, wherein the threaded hole penetrates the driving member in the axial direction, the stopper pin and the set pin are attached in an outer-end portion of the driving member, that outer-end portion penetrates the bottom wall of the bypass valve, the stopper pin and the set pin being attached so as to penetrate the driving member laterally, and grease is filled in a portion of the threaded hole that is located between the stopper pin and the set pin.

5. The bypass-intake-flow control apparatus according to claim 1 further comprising:

rotation preventing means that prevents the bypass valve from rotating and that allows the bypass valve to slide in the axial direction; and a partition wall that is contiguous from the outer circumferential surface of the bypass valve, wherein the rotation preventing means includes:

a key groove that is formed in a side surface of the bypass valve and that extends in the axial direction; and a key that is provided in a protruding manner in the inner surface of the valve hole, and that slidably engages with the key groove, and at least an end of the key groove is closed by the partition wall.

* * * * *